United States Patent [19]

Compere

[11] 4,150,458

[45] Apr. 24, 1979

[54] BODY SCRUBBER

[76] Inventor: Louis Compere, R.F.D. #1, Box 731, Florence, Miss. 39073

[21] Appl. No.: 905,140

[22] Filed: May 12, 1978

[51] Int. Cl.[2] ..... A47K 7/02

[52] U.S. Cl. ..... 15/222

[58] Field of Search ..... 15/222, 209 R, 104.94; 401/6, 7, 8

[56] References Cited

U.S. PATENT DOCUMENTS

| | | | |
|---|---|---|---|
| 1,914,796 | 6/1933 | Badgley | 15/222 |
| 1,996,531 | 4/1935 | Thrasher et al. | 15/222 |
| 3,364,511 | 1/1968 | Martin | 15/222 |

*Primary Examiner*—George F. Mautz
*Attorney, Agent, or Firm*—Daniel Jay Tick

[57] ABSTRACT

First and second identical hand grips each comprise a square U-shaped member having a hand-gripped head part and a pair of spaced parallel arms extending perpendicularly from the ends of the head part. A plurality of bars are affixed to, and extend perpendicularly between, the arms in the area of the free ends thereof, parallel to the head part. An endless closed loop strip of body scrubbing cloth is mounted on and looped around selected bars of the hand grips and extends between such hand grips.

1 Claim, 3 Drawing Figures

BODY SCRUBBER

BACKGROUND OF THE INVENTION

The present invention relates to a body scrubber.

Body scrubbers of the type disclosed herein are described in U.S. Pat. Nos. 1,990,568; 2,544,354; 3,024,486; 3,063,081; 3,364,511 and 3,875,933.

Objects of the invention are to provide a body scrubber of simple structure, which is inexpensive in manufacture, used with facility and convenience, and functions efficiently, effectively and reliably to scrub any desired part of the body with facility and convenience.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
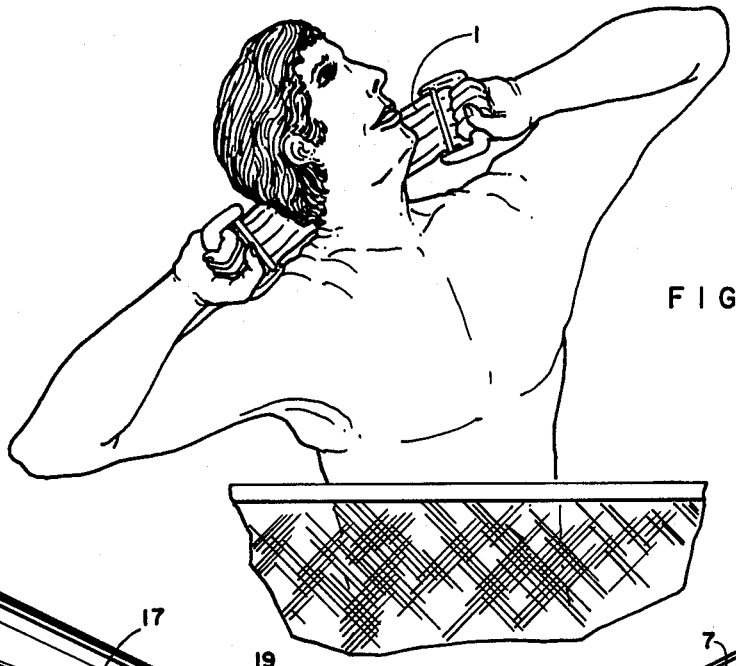
FIG. 1 is a view of an embodiment of the body scrubber of the invention in use.
Figure 2:
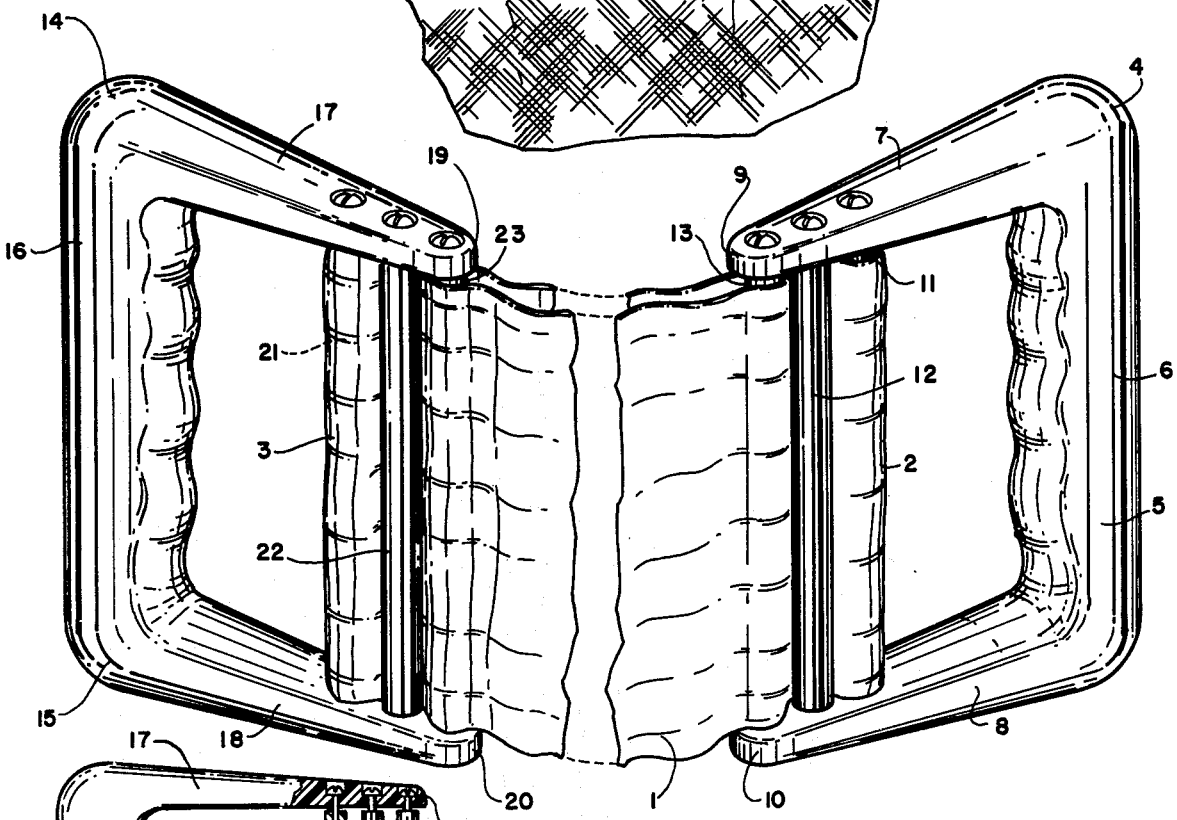
FIG. 2 is a perspective view, on an enlarged scale, of the embodiment of FIG. 1.

The body scrubber of the invention comprises an endless closed loop strip of body scrubbing cloth 1 having spaced opposite first and second looped ends 2 and 3, respectively, as shown in FIG. 2, when stretched substantially flat.

A first hand grip 4 comprises a first substantially squareU-shaped member 5 having a hand-gripped head part 6 and a pair of spaced parallel arms 7 and 8 extending substantially perpendicularly from the ends of said head part, as shown in FIG. 2. The arms 7 and 8 have free ends 9 and 10, respectively, spaced from the head part 6, as shown in FIG. 2. The hand grip 4 preferably comprises plastic of any suitable type.

A plurality of bars 11, 12 and 13, respectively, are affixed to, and extend substantially perpendicularly between, the arms 7 and 8 in the area of the free ends 9 and 10 thereof parallel to the head part 6 (FIG. 2).

Figure 3:
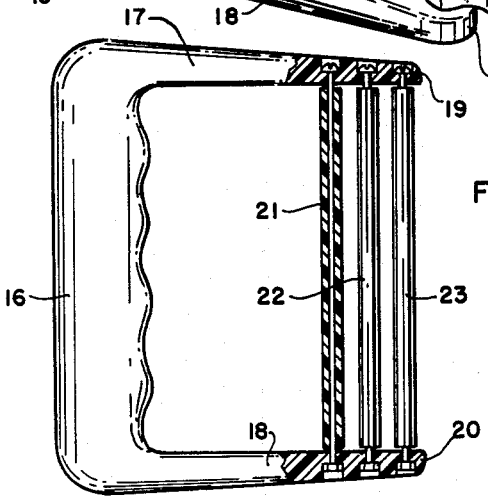
FIG. 3 is a view, on an enlarged scale, partly cutaway and partly in section, of a hand grip of the body scrubber of the invention.

A second hand grip 14 is essentially identical to the first hand grip 4 and comprises a second substantially square U-shaped member 15 having a hand-gripped head part 16 and a pair of spaced parallel arms 17 and 18, respectively, extending substantially perpendicularly from the ends of said head part, as shown in FIGS. 2 and 3. The arms 17 and 18 have free ends 19 and 20, respectively, spaced from the head part 16, as shown in FIGS. 2 and 3.

A plurality of bars 21, 22 and 23, respectively, are affixed to, and extend substantially perpendicularly between, the arms 17 and 18, in the area of the free ends thereof parallel to the head part 16.

The bar 11 closest to the head part 6 of the first member 5 passes through the strip of cloth 1 at the first looped end 2 thereof, as shown in FIG. 2. The strip of cloth 1 passes around the next-adjacent bar 12 of the first member 5, as shown in FIG. 2. The bar 13 farthest from the head part 6 of the first member 5 passes through the strip of cloth 1 (FIG. 2). The bar 21, closest to the head part 16 of the second member 15 passes through the strip of cloth 1 at the second looped end 3 thereof, as shown in FIG. 2. The strip of cloth 1 passes around the next-adjacent bar 22 of the second member 15, as shown in FIG. 2. The bar 23, farthest from the head part 16 of the second member 15, passes through the strip of cloth 1 (FIG. 2).

The strip of cloth 1 comprises any suitable scrubbing cloth of any desired texture such as, for example, terrycloth.

While the invention has been described by means of a specific example and in a specific embodiment, I do not wish to be limited thereto, for obvious modifications will occur to those skilled in the art without departing from the spirit and scope of the invention.

I claim:

1. A body scrubber, comprising an endless closed loop strip of body scrubbing cloth having spaced opposite first and second looped ends when stretched substantially flat;

a first hand grip comprising a first substantially square U-shaped member having a hand-gripped head part and a pair of spaced parallel arms extending substantially perpendicularly from the ends of the head part and having free ends spaced from said head part, and a plurality of bars affixed to and extending substantially perpendicularly between the arms in the area of the free ends thereof parallel to said head part; and a second hand grip comprising a second substantially square U-shaped member having a hand-gripped head part and a pair of spaced parallel arms extending substantially perpendicularly from the ends of the head part and having free ends spaced from said head part, and a plurality of bars affixed to and extending substantially perpendicularly between the arms in the area of the free ends thereof parallel to said head part, the bar closest to the head part of the first member passing through the strip of cloth at the first looped end thereof, said strip of cloth passing around the next-adjacent bar of said first member and the bar farthest from the head part of the first member passing through said strip of cloth, the bar closest to the head part of the second member passing through said strip of cloth at the second looped end thereof, said strip of cloth passing around the next-adjacent bar of said second member and the bar farthest from the head part of the second member passing through said strip of cloth.

* * * * *